US007513440B2

(12) United States Patent
Magel

(10) Patent No.: US 7,513,440 B2
(45) Date of Patent: Apr. 7, 2009

(54) PRESSURE-BOOSTED FUEL INJECTION DEVICE COMPRISING AN INTERNAL CONTROL LINE

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 81 days.

(21) Appl. No.: 10/531,166

(22) PCT Filed: Oct. 7, 2003

(86) PCT No.: PCT/DE03/03314

§ 371 (c)(1),
(2), (4) Date: Apr. 11, 2005

(87) PCT Pub. No.: WO2004/036027

PCT Pub. Date: Apr. 29, 2004

(65) Prior Publication Data

US 2006/0043209 A1 Mar. 2, 2006

(30) Foreign Application Priority Data

Oct. 14, 2002 (DE) ..... 102 47 903

(51) Int. Cl.
*F02M 47/02* (2006.01)

(52) U.S. Cl. ..... 239/88; 239/96; 239/124; 239/533.9

(58) Field of Classification Search ..... 239/88, 239/96, 89–92, 533.3, 533.9, 124
See application file for complete search history.

(56) References Cited

U.S. PATENT DOCUMENTS

| | | | | |
|---|---|---|---|---|
| 4,437,443 | A | 3/1984 | Hofbauer | |
| 4,538,576 | A * | 9/1985 | Schneider | 123/446 |
| 4,627,571 | A * | 12/1986 | Kato et al. | 239/90 |
| 6,453,875 | B1 | 9/2002 | Mahr et al. | |
| 6,805,101 | B2 | 10/2004 | Mägel | |
| 2002/0023970 | A1 * | 2/2002 | Boecking | 239/96 |
| 2004/0025843 | A1 | 2/2004 | Magel | |
| 2004/0025845 | A1 | 2/2004 | Magel | |
| 2004/0149265 | A1 | 8/2004 | Magel et al. | |
| 2004/0206335 | A1 | 10/2004 | Braun et al. | |

FOREIGN PATENT DOCUMENTS

| | | | |
|---|---|---|---|
| DE | 31 02 697 | A1 | 10/1982 |
| DE | 199 10 970 | A1 | 9/2000 |
| DE | 101 23 914 | A1 | 11/2002 |
| DE | 102 18 904 | A1 | 12/2002 |
| WO | WO01/38712 | A2 * | 5/2001 |
| WO | WO 02/092992 | A1 | 11/2002 |
| WO | WO 02/092997 | A1 | 11/2002 |
| WO | WO 02/092998 | A1 | 11/2002 |
| WO | WO 02/092999 | A1 | 11/2002 |

* cited by examiner

*Primary Examiner*—Christopher S Kim
(74) *Attorney, Agent, or Firm*—Ronald E. Greigg

(57) ABSTRACT

The invention relates to a fuel injection device with a multi-part injector body containing a pressure booster that can be actuated by means of a differential pressure chamber, and includes a pressure booster piston that seals a working chamber off from the differential pressure chamber. An on-off valve disposed above the injector body can actuate the fuel injection device. A pressure change in the differential pressure chamber occurs via a central control line that extends through the pressure booster piston of the pressure booster.

11 Claims, 4 Drawing Sheets

PRESSURE-BOOSTED FUEL INJECTION DEVICE COMPRISING AN INTERNAL CONTROL LINE

CROSS-REFERENCE TO RELATED APPLICATIONS

This application is a 35 USC 371 application of PCT/DE 03/03314 filed on Oct. 7, 2003.

BACKGROUND OF THE INVENTION

1. Field of the Invention

Both pressure-controlled and stroke-controlled injection systems can be used to deliver fuel into combustion chambers of autoignition internal combustion engines. Injection systems with high-pressure reservoirs have the advantage that the injection pressure can be adapted to the load and speed of the engine. A high injection pressure is required in order to reduce emissions produced and to achieve a high specific output of the engine. Since the pressure level that high-pressure fuel pumps can achieve in the high-pressure reservoir is limited for strength reasons, a pressure booster at the fuel injector can be used to boost pressure further in fuel injection devices with a high-pressure reservoir.

2. Prior Art

DE 199 10 907 A1 has disclosed a fuel injection device that has a pressure booster unit disposed between a pressure reservoir and a nozzle chamber. Its pressure chamber communicates with the nozzle chamber via a pressure line. A bypass line is also provided, which is connected to the pressure reservoir. The bypass line is connected directly to the pressure line. The bypass line can be used for a pressure injection and is disposed parallel to the pressure chamber so that it is continuously open independent of the movement and position of a movable lever of the pressure boosting unit.

DE 102 18 904.8 relates to a fuel injection device for internal combustion engines having a fuel injector which can be supplied from a high-pressure fuel source, and a pressure-boosting unit. The closing piston of the fuel injector protrudes into a closing pressure chamber so that the closing piston can be subjected to fuel pressure in order to produce a force that acts on the closing piston in the closing direction; the closing pressure chamber and the return chamber of the pressure boosting unit are constituted by a shared closing pressure/return chamber. All of the partial regions of the closing pressure/return chamber are permanently connected to one another to permit the exchange of fuel. The pressure boosters known from DE 199 10 970 A1 and DE 102 18 904.8 are actuated by means of an exertion of pressure on or relief of pressure in a return chamber of the pressure booster. Controlling a pressure booster via the return chamber is advantageous in terms of discharge losses and permits a simple triggering of the pressure booster by means a 2/2-way valve.

The disadvantage of the pressure boosters known from DE 199 10 970 A1 and DE 102 18 904.8 is the routing of the control bore for relieving the pressure in the return chamber of the pressure booster. Due to the fact that the control valve for the pressure booster is disposed above the pressure booster in most internal combustion engines for space reasons, it is necessary for the control line that is subjected to the fuel pressure prevailing in the high-pressure reservoir to be routed out of the return chamber of the pressure booster and past the pressure booster. This requires a larger outer diameter of the fuel injector into which the pressure booster is incorporated, as a rule in the head region, or requires an eccentric placement of the pressure boosting element that is disposed in the pressure booster and is, as a rule, embodied in the form of a piston. This previously required line routing resulted in bore intersections in the control line for exerting pressure on or relieving pressure in the return chamber of the pressure booster. As a rule, bore intersections involve high material stresses, which require costly machining steps and are detrimental to a durable design of a fuel injector.

SUMMARY OF THE INVENTION

The design proposed according to the invention makes it possible to achieve an improvement in the high-pressure tightness of a fuel injector with a pressure booster. The elimination of a control line running along the outside of the fuel injector with pressure booster reduces the external dimensions of the fuel injector or avoids a placement of a pressure booster eccentric to the fuel injector.

A control line disposed in the booster piston and extending coaxial to the symmetry axis of the fuel injector advantageously avoids bore intersections of the kind that necessarily occur in external lines because of the connection location of the high-pressure connections and reduces material stresses, which in turn extends the service life of the fuel injector with pressure booster. The central control line, which is for relieving pressure in or exerting pressure on a differential pressure chamber used to actuate the pressure booster, extends through a pressure booster working chamber that is subjected to high pressure. A seal between this working chamber and the central control line can be achieved by means of a sealing sleeve that is prestressed by a spring element and advantageously cooperates with a flat seat in the working chamber. This makes it possible to compensate for manufacture related tolerances in a fuel injector with pressure booster that is comprised of a number of housing parts to be joined to one another. The central control line extends through an extension, which is embodied on the piston of the pressure booster and has a guide section for the movable sealing sleeve disposed on the piston extension.

In another embodiment variant of the concept underlying the invention, a piston extension on the booster piston of the pressure booster can be contained in a high-pressure-tight guide provided in one of the housing parts of the fuel injector with pressure booster. The high-pressure-tight guide of the piston extension is designed so that it is effective along the entire stroke path of the pressure booster piston and separates the central control line from the working chamber of the pressure booster.

Instead of a piston extension embodied on the piston of the pressure booster and housing the central control line, the pressure booster piston can contain a piston that has a conduit extending all the way through it. According to this embodiment variant, a sealing point can be embodied as a flat seat in order to seal the central control line off from the working chamber of the pressure booster. On the one hand, this makes it possible to compensate for tolerances between the housing parts and on the other hand, permits a simple manufacture from a production engineering standpoint. In another embodiment variant of a fuel injector with pressure booster, the pressure booster has a piston element extending all the way through it, which in turn has a conduit extending all the way through it. Depending on the stroke path of the pressure booster, the conduit is connected to the differential pressure chamber of the pressure booster via a first outlet cross section or via the first outlet cross section and a second outlet cross section. This makes it possible to control the pressure buildup of the pressure booster in accordance with a desired injection pressure.

The central control line can be used in all pressure boosters that are controlled via a differential pressure chamber.

BRIEF DESCRIPTION OF THE DRAWINGS

The invention will be explained in detail below in conjunction with the drawings, in which.

DESCRIPTION OF THE PREFERRED EMBODIMENTS

Figure 1:
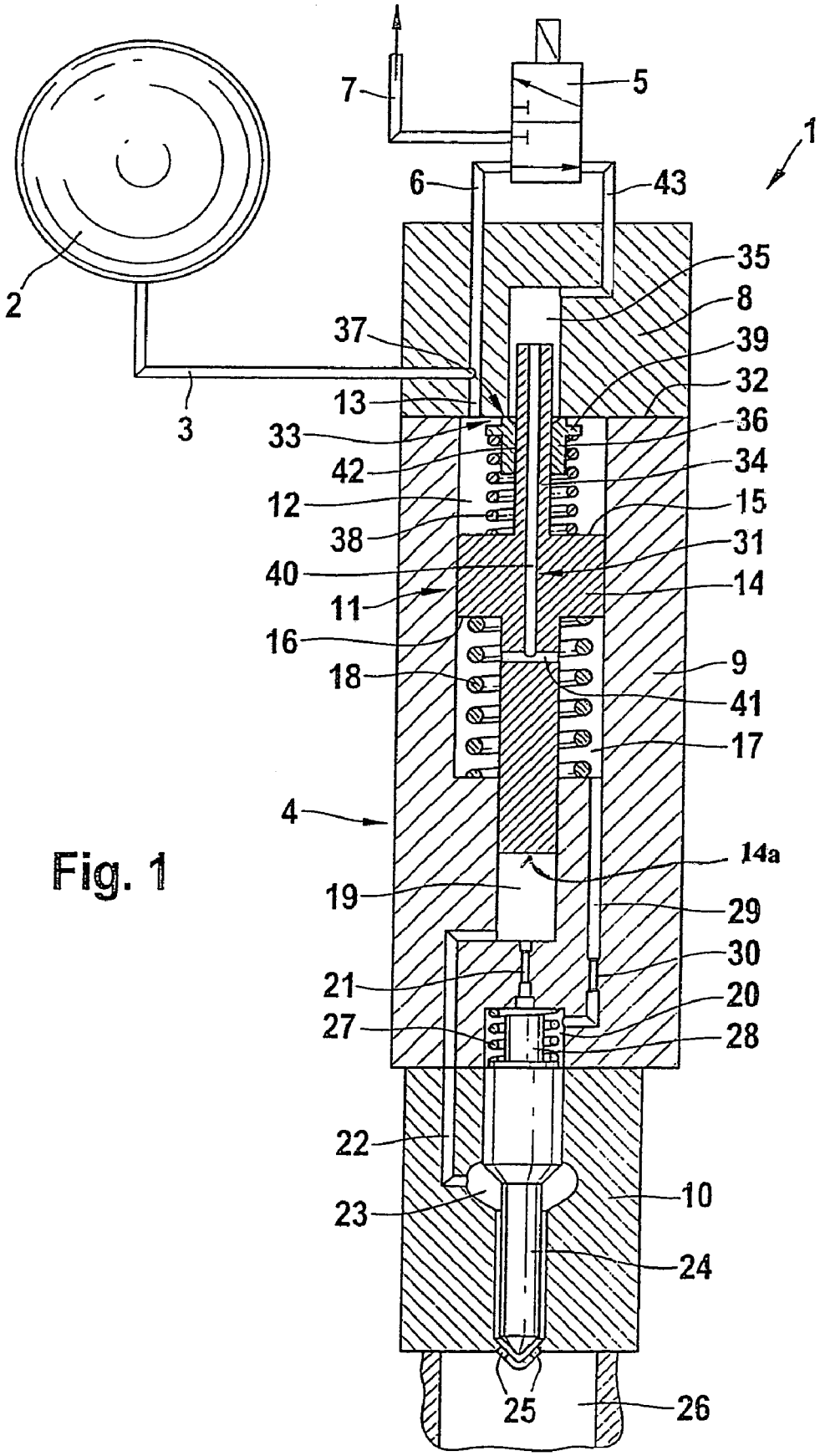
FIG. 1 shows a fuel injector with pressure booster, with a high-pressure-tight connection at the upper end of the working chamber.

FIG. 1 shows an embodiment variant of a fuel injector with pressure booster whose piston has a piston extension with a section of the central control line passing through it.

According to the first exemplary embodiment of the concept underlying the invention shown in FIG. 1, a high-pressure reservoir 2 (common rail) acts on a fuel injection device 1 with highly pressurized fuel. The highly pressurized fuel contained in the high-pressure reservoir 2 flows to an injector body 4 of the fuel injection device 1 via a high-pressure line 3. The high-pressure line 3 feeds into a first housing part 8 of the fuel injection device 1. From the first housing part 8, an inlet 6 extends to an on-off valve 5. On the one hand, the on-off valve 5 has a low-pressure side return 7 branching from it, which feeds into a fuel reservoir not shown in FIG. 1, and on the other hand, the valve has an overflow line 43, which communicates with a recess 35 inside the first housing part 8.

The injector body 4 of the injection device 1 has a first housing part 8, an additional, second housing part 9, and an injector housing 10 that encompasses an injection valve element 24. The first housing part 8 and the second housing part 9 rest against each other along a butt joint 32.

The injector body 4 of the fuel injection device 1 contains a pressure booster 11. The pressure booster 11 includes a working chamber labeled with the reference numeral 12, which can be acted on with highly pressurized fuel via an inlet 13 branching from the high-pressure line 3. The pressure booster 11 has a pressure booster piston 14 that has a first end 15 oriented toward the working chamber 12 and a second end 16 oriented toward a differential pressure chamber 17. At the second end 16, the pressure booster piston 14 rests against a return spring 18, which in turn rests against an annular surface inside the second housing part 9 of the injector body 4. The pressure booster piston 14 of the pressure booster 11 acts on a high-pressure chamber 19 contained in the lower region of the second housing part 9 and defined, at least in part, by an end face 14*a* of the pressure booster piston 14. When the end of the pressure booster piston 14 oriented toward the high-pressure chamber 19 travels inward, the fuel contained in this chamber is compressed even more as a function of the boosting ratio of the pressure booster 11, and flows into a control chamber 20 and into a nozzle chamber 23 contained in the injector housing 10 via a nozzle chamber inlet 22. The nozzle chamber 23 encloses the injection valve element 24 of the fuel injection device in a region in which a pressure shoulder is provided on the injection valve element 24. An annular gap extends from the nozzle chamber 23 to the end of the fuel injection device 1 oriented toward the combustion chamber. Via the annular gap, injection openings 25 at the combustion chamber end of the fuel injection device 1 are acted on with fuel. These injection openings are unblocked with a vertical movement of the injection valve element 24 so that highly pressurized fuel can be injected via the injection openings 25 into a combustion chamber 26 of an autoignition internal combustion engine.

The exertion of pressure on the control chamber 20 in order to actuate the injection valve element 24, which is embodied for example in the form of a nozzle needle, occurs via a line that contains an inlet throttle 21 and connects the control chamber 20 to the high-pressure chamber 19 of the pressure booster 11. The control chamber 20 contains a nozzle spring 27, which encompasses a pin 28 of the injection valve element and rests against an annular surface of the injection valve element 24. A discharge line 29 that contains an outlet throttle 30 extends between the differential pressure chamber 17 of the pressure booster 11 and the control chamber 20.

The pressure booster piston 14 of the pressure booster 11 contains a central control line 31. The central control line 31 is connected to the differential pressure chamber 17 of the pressure booster 11 via a lateral opening 41 embodied in the pressure booster piston 14. The lateral opening 41 is in turn connected to a conduit 40 representing the central control line 31, which conduit passes through the section of the pressure booster piston 14 sealing the working chamber 12 off from the differential pressure chamber 17 and extends through a piston extension 34 disposed at the first end 15 of the pressure booster piston 14. The piston extension 34 that contains the conduit 40 and is disposed at the first end 15 of the pressure booster piston 14 extends into the recess 35 in the first housing part 8 of the injector body 4. A first sealing sleeve 36 can move within a guide section 42 on the piston extension 34 of the pressure booster piston 14. The first sealing sleeve 36 has an annular shoulder 39 against which an adjusting spring 38 rests. With its end opposite from the first sealing sleeve 36, the adjusting spring 38 rests against the first end 15, encompassing the piston extension 34. The adjusting spring 38 acts on the first sealing sleeve 36 mounted on the piston extension 34 so that its sealing surface 37 rests against the underside of the first housing part 8 of the injector body 4. This allows a high-pressure-tight connection 33 to be produced, which seals the central control line 31 off from the working chamber 12 of the pressure booster 11. According to the exemplary embodiment shown in FIG. 1, in order to compensate for manufacturing tolerances between the first housing part 8 and the second housing part 9 of the fuel injector 4, the high-pressure-tight connection 33 can be embodied as a flat seat. In addition, the section of the piston extension 34 protruding into the recess 35 of the first housing part 8 can be guided with radial play in the recess 35 so that a contact-free guidance can be achieved between the upper region of the piston extension 34 and the recess 35 in the first housing part 8.

The exemplary embodiment shown in FIG. 1 functions as follows:

At the beginning of an injection, the on-off valve 5 is switched from its position shown in FIG. 1, which corresponds to its closed position, into an open position. In the open position of the on-off valve 5, the low-pressure side return 7 and the overflow line 43 are connected to each other. While the working chamber 12 of the pressure booster 11 remains connected to the high-pressure reservoir 2 via the branch 13 from the high-pressure line 3, fuel flows from the differential pressure chamber 17, through the pressure booster piston 1 via the lateral opening 41 and the conduit 40 that constitutes the central control line 31, into the recess 35 in the first housing part 8 and from there, into the low-pressure side return 7 via the overflow line. As a result of the high pressure level still prevailing in the working chamber 12 of the pressure booster 11, the lower end of the pressure booster piston 14 travels into the high-pressure chamber 19. Fuel flows from this chamber at a pressure level, which is higher than the pressure level of the high-pressure reservoir 2 and depends on the boosting ratio of the pressure booster 11, and travels on the one hand into the nozzle chamber 23 via the nozzle inlet 22 and on the other hand, flows into the control chamber 20 via the inlet throttle 21. The highly pressurized fuel rushing into the nozzle chamber 23 acts on the pressure shoulder of the injection valve element 24 and produces a vertical stroke motion of the injection valve element 24 in the opening direction, counter to the action of the nozzle spring 27, which is likewise contained in the control chamber 20. A diversion volume displaced by the stroke motion flows through the pressure relief line 29, which contains an outlet throttle 30, into the differential pressure chamber 17 of the pressure booster 11.

The injection openings 25 that feed into the combustion chamber 26 of an autoignition internal combustion engine are acted on with highly pressurized fuel as a result of the vertical stroke motion of the injection valve element 24 and inject this fuel into the combustion chamber 26 of the engine.

With a subsequent switching of the on-off valve 5, the high-pressure reservoir 2 exerts pressure on the differential pressure chamber 17 via the high-pressure line 3, the inlet 6, the overflow line 43, and the recess 35 in the first housing part 8. From there, the fuel flows through the conduit 40 constituting the central control line 31 and travels into the differential pressure chamber 17 via the lateral opening 41, once again acting on the differential pressure chamber 17 with the pressure level prevailing in the high-pressure reservoir 2. This relieves the pressure in the high-pressure chamber 19 as well as in the nozzle chamber 23 encompassing the injection valve element 24 in the injector housing 10. The nozzle spring 27 pushes the injection valve element 24 into its seat oriented toward the combustion chamber, thus terminating the injection. The control chamber 20 is refilled via the discharge line 29, which in this case allows fuel to flow through in the opposite direction, refilling the control chamber 20. The high-pressure chamber 19 of the pressure booster 11 is refilled with an overflow of fuel from the control chamber 20 that flows into the high-pressure chamber 19 via the line containing the inlet throttle 21.

In the embodiment variant of the concept underlying the invention shown in FIG. 1, the piston extension 34 is disposed at the first end 15 of the pressure booster piston 11. When the pressure booster 11 is triggered, a fuel volume flows either out of the differential pressure chamber 17 or into it through this piston extension 34. In this embodiment variant, the recess 35 inside the first housing part 8 is sealed by the first sealing sleeve 36 that is guided in a moving fashion on the piston extension 34. In a manner that is particularly easy to manufacture from a production engineering standpoint, this sealing sleeve can be provided with a flat seat, which can effectively seal the high-pressure-tight connection 33 between the working chamber 12 and the recess 35 in the first housing part 8 into which the conduit 40 that constitutes the central control line 31 feeds. The first sealing sleeve 36, which is guided in a moving fashion on the piston extension 34, advantageously rests against an adjusting spring 38. The dimensioning of the adjusting spring 38 makes it possible to assure the effectiveness of the high-pressure-tight connection 33 at the lower end of the first housing part 8 over the entire stroke path of the pressure booster piston 14 inside the second housing part 9 of the injector body 4. The routing of the central control line 31 essentially coaxial to the symmetry line of the injector body 4 eliminates the need for providing an additional high-pressure line to the on-off valve 5 on the outside of the injector body 4, which line would be required for controlling the differential pressure chamber 17 of the pressure booster 11. A pressure booster 11 that is triggered via the differential pressure chamber 17 (also referred to as the return chamber) is particularly advantageous in terms of its discharge losses. With the design proposed according to the invention, it is possible for a pressure booster 11 that is controlled via its differential pressure chamber 17 to be disposed coaxial to the injector housing 10 of the fuel injection device 1 without negatively influencing the outer dimensions of the injector body 4. As a result, it is also possible to avoid placing the pressure booster 11 eccentrically in relation to the injection valve element 24 disposed in the symmetry axis of the fuel injection device 1, which would be disadvantageous with regard to production complexity and costs.

Figure 2:
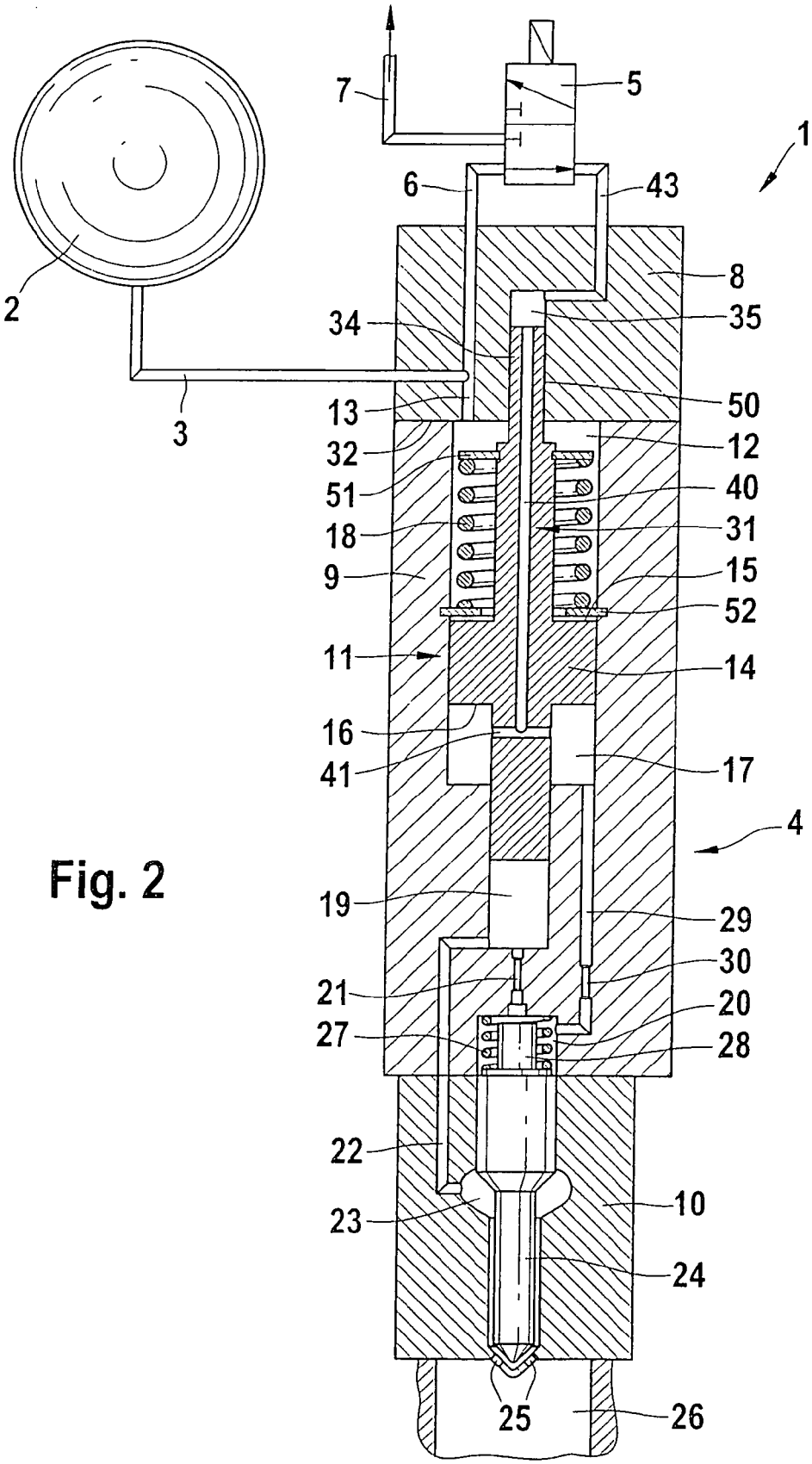
FIG. 2 shows a fuel injector with pressure booster in which a control line section is housed in a high-pressure-tight guide.

FIG. 2 shows an embodiment variant of a fuel injector with pressure booster in which the central control line extends through a piston extension that is guided in a high-pressure-tight guide of the injector body 4.

According to the embodiment variant shown in FIG. 2, the fuel injection device 1 is supplied with highly pressurized fuel by the pressure reservoir 2 (common rail). Fuel flows from the pressure reservoir 2 through the high-pressure line 3 to the first housing part 8 of the injector body 4. The first housing part 8 of the fuel injection device 1 rests against the second housing part 9 of the injector body 4 at a butt joint 32. The injector body 4 of the fuel injection device 1 also includes the injector housing 10 that contains the injection valve element 24, which can be embodied as a nozzle needle and opens or closes the injection valve openings 25.

Highly pressurized fuel flows through the high-pressure line 3 to the first housing part 8 of the injector body 4 of the fuel injection device 1. It is conveyed via the inlet to the on-off valve 5. The on-off valve 5 has a connection to the low-pressure side return 7 and to an overflow line 43 leading to the recess 35 contained in the first housing part 8. The branch 13 of the high-pressure line 3 inside the first housing part 8 acts on the working chamber 12 of the pressure booster 11 with highly pressurized fuel. The pressure booster 11 has a pressure booster piston 14 that seals the working chamber 12 of the pressure booster 11 off from the differential pressure chamber 17 of the pressure booster 11. The pressure booster piston 14 includes the piston extension 34 attached to the first end 15. A first washer 51 is disposed on the piston extension 34 extending through the working chamber 12 in the second housing part 9. An additional, second washer 52 is provided above the pressure booster piston 14, inside the working chamber 12 of the pressure booster 11. A return spring 18 is disposed between the first and second washers 51, 52 and returns the pressure booster piston 14 to its initial position inside the second housing part 9.

The lower end of the pressure booster piston 14 acts on the high-pressure chamber 19 contained in the second housing part 9 of the injector body 4. The high-pressure level that can be achieved in the high-pressure chamber 19 depends on the boosting ratio of the pressure booster 11 and is higher than the pressure level prevailing in the high-pressure reservoir 2. Fuel flows from the high-pressure chamber 19 of the pressure booster 11 at a further increased pressure level, traveling via the nozzle chamber inlet 22 into the nozzle chamber 23 in the injector housing 10. In the region of the nozzle chamber 23, the injection valve element 24, which can be embodied for example as a nozzle needle, has a pressure shoulder that encompasses the injection valve element 24. The nozzle chamber 23 inside the injector housing 10 has an annular gap extending from it via which the highly pressurized fuel can flow from the nozzle chamber 23 to the injection openings 25. When the injection valve element 24 is open, very highly pressurized fuel is injected through the injection openings 25 into the combustion chamber 26 of the autoignition internal combustion engine.

In addition, a line section extends from the high-pressure chamber 19 to the control chamber 20. This line section contains an inlet throttle 21. The control chamber 20 for the injection valve element 24 contains a nozzle spring 27, which rests against an annular surface of the injection valve element 24 at one end, encompassing a pin 28. At the other end, the nozzle spring 27 rests against a wall of the second housing part 9 delimiting the control chamber 20. An overflow of control volume from the control chamber 20 into the differential pressure chamber 17 of the pressure booster 11 occurs via the discharge line 29 that contains an outlet throttle 30 and connects the control chamber 20 to the differential pressure chamber 17.

The pressure booster piston 14 of the pressure booster 11 contains a central control line 31. The central control line 31 is embodied as a conduit 40 that passes through both the piston extension 34 and the pressure booster piston 14 and has a lateral opening 41 at its lower end that feeds into the differential pressure chamber 17. This lateral opening can be embodied as a bore, a conduit, or the like contained in the pressure booster piston 14. From the lateral opening 41 in the pressure booster piston 14, the conduit 40 extends into the recess 35 in the first housing part 8 of the injector body 4. The first housing part 8 encompasses the head region of the piston extension 34 in a high-pressure-tight guide 50. The high-pressure-tight guide 50 inside the first housing part 8 transitions into the recess 35 and is embodied with an axial length that corresponds to the stroke path of the pressure booster piston 14. This assures that a high-pressure seal between the recess 35 inside the first housing part 8 and the working chamber 12 of the pressure booster 11 is maintained along the entire stroke path of the pressure booster piston 14 of the pressure booster 11.

In the position shown in FIG. 2, the pressure booster 11 is in its idle position. The differential pressure chamber 17 and the working chamber 12 are connected to the pressure reservoir 2 via the on-off valve 5 and the inlet 13 to the working chamber 12 and via the inlet 43, 35, 40 to the differential pressure chamber 17. Therefore in the switched position of the on-off valve 5 shown in FIG. 2, the identical pressure prevails in the working chamber 12 and in the differential pressure chamber 17. The pressure level prevailing in the differential pressure chamber 17 also prevails in the control chamber 20 of the injection valve element 24 via the discharge line 29 branching from the differential pressure chamber 17 of the pressure booster and the outlet throttle 30 that this discharge line contains.

When the on-off valve 5 is actuated, i.e. when it is moved from the switched position shown in FIG. 2 into a switched position in which the overflow line 43 is brought into a connection with the low-pressure side return 7, this relieves the pressure in the differential pressure chamber 17. The fuel flows from the differential pressure chamber 17 via the lateral opening 41 embodied in the pressure booster piston 14, into the conduit 40 that constitutes the central control line 31 and from there, into the recess 35 inside the first housing part 8. The fuel flows from the recess 35 via the overflow line 43 into the low-pressure side return 7 and from there, into a fuel reservoir that is not shown in FIG. 2. Because of the relief of the pressure in the differential pressure chamber 17, the lower end of the pressure booster piston 14 travels into the second housing part 9 of the injector body 7 due to the high pressure level prevailing in the working chamber 12. This causes the lower end of the pressure booster piston 14 to act on the fuel contained in the high-pressure chamber 19. The fuel compressed in the high-pressure chamber 19 flows into the nozzle chamber 23 via the nozzle chamber inlet 22. This acts on the hydraulic surface of the pressure shoulder on the injection valve element 24, thus causing the injection valve element 24 to travel into the control chamber 20 in opposition to the nozzle spring 27 contained in this control chamber, thus also unblocking the injection openings 25. The fuel volume, which is displaced by the insertion of the injection valve element 24 and the pin 28 into the control chamber 20, flows out into the differential pressure chamber 17 via the discharge line 29. Because of the opening movement of the injection valve element 24, the fuel rushing into the nozzle chamber 23 flows along the annular gap encompassing the injection valve element 24 in the injector housing 10, to the injection openings 25 and from there, is injected into the combustion chamber 26 of the autoignition internal combustion engine.

However, if the on-off valve 5 is switched into its initial position shown in FIG. 2, then the differential pressure chamber 17 of the pressure booster 11 is filled via the high-pressure line 3, the inlet 6 to the on-off valve 5, the overflow line 43, and the recess 35. From the recess 35 inside the first housing part 8, the fuel flows through the conduit 40 of the piston extension 34 in the direction opposite the relief direction of the differential pressure chamber 17. The fuel that flows into the differential pressure chamber 17 from the lateral opening 41 refills the differential pressure chamber 17. The differential pressure chamber 17 refills the control chamber 20 via the discharge line 29. The control chamber 20 fills the high-pressure chamber 19 of the pressure booster 11 with fuel again via the line that contains the inlet throttle 21.

The embodiment variant shown in FIG. 2 requires fewer individual parts and is therefore less expensive to produce.

Figure 3:
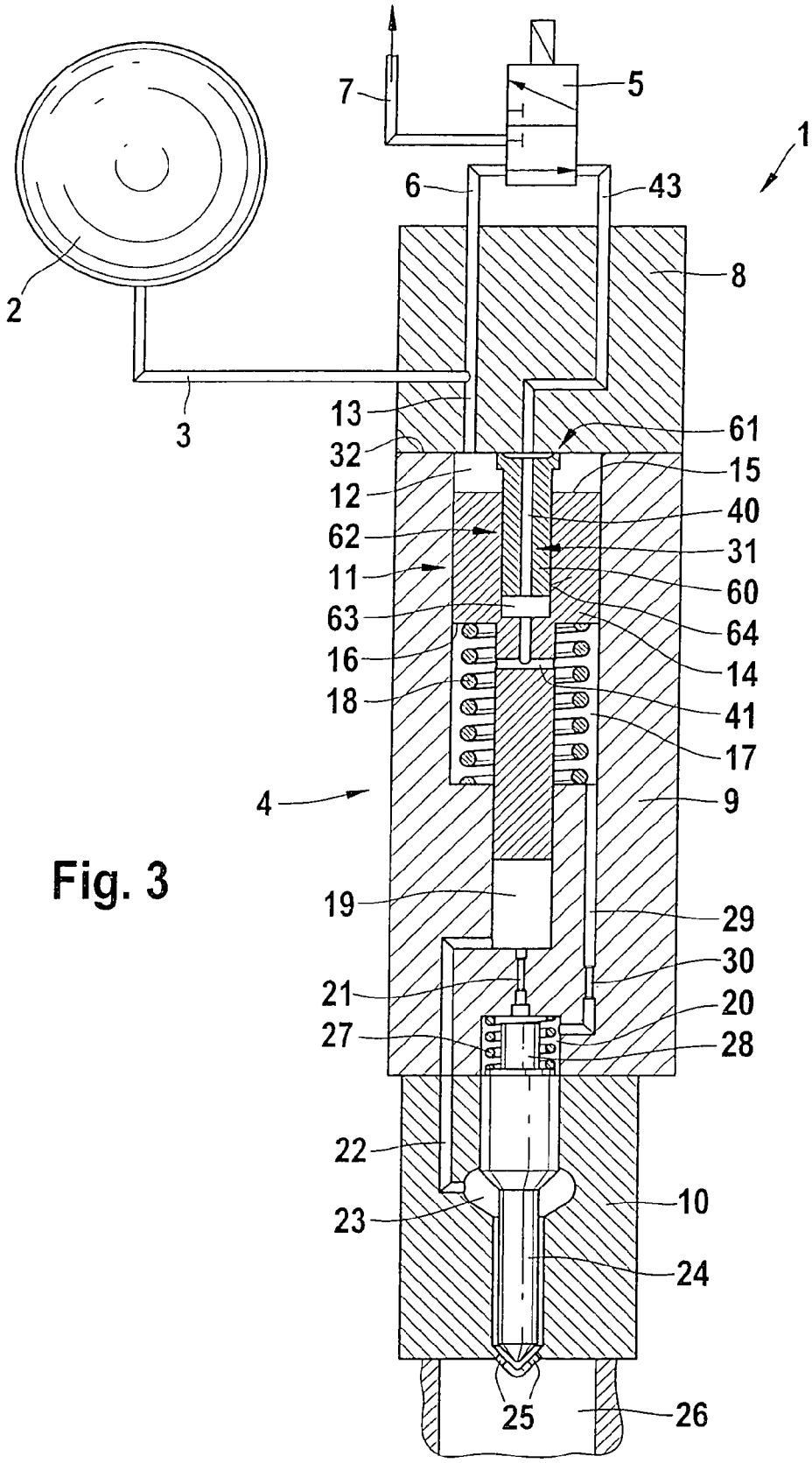
FIG. 3 shows an embodiment variant of the fuel injector with pressure booster, with a piston element that is inserted part way into the pressure booster piston and constitutes a sealing seat.

FIG. 3 shows an embodiment variant of the fuel injector with pressure booster, with a piston element inserted part way into the pressure booster piston.

The embodiment variant of a fuel injector with pressure booster shown in FIG. 3 differs from the embodiment variants of a fuel injector with pressure booster shown in FIGS. 1 and 2 in that a piston part 60 is integrated into the pressure booster piston 14. The piston part 60 is contained so that it can slide inside the pressure booster piston 14. Between the lower end of the piston part 60 and the pressure booster piston, a chamber 63 is provided and the piston part 60 contained in the pressure booster piston 14 has a sealing seat 61, which is disposed at its end oriented toward the first housing part 8 and is once again embodied as a flat seat in order to compensate for tolerances between the first housing part 8 and the second housing part 9 of the injector body 4. The central control line 31, which extends through the piston part 60 in the form of a conduit 40, is sealed off from the working chamber 12 of the pressure booster 11 by the sealing seat 61. The guide surface for the piston part 60 in the pressure booster piston 14 is labeled with the reference numeral 64. The sealing seat is disposed in a larger diameter, disk-shaped region of the piston part 60 that is inserted into the pressure booster piston 14. The fuel contained in the working chamber 12 of the pressure booster 11 pushes the piston part 60 against the first housing part 8 via this annular surface and consequently assists in the sealing action of the sealing seat 61 between the working chamber 12 and the central control line 31 that serves to relieve the pressure in or exert pressure on the differential pressure chamber 17 of the pressure booster 11.

Otherwise, the exemplary embodiment shown in FIG. 3 corresponds to the exemplary embodiments that have already been described in conjunction with FIGS. 1 and 2.

The exemplary embodiment of a fuel injection device shown in FIG. 3 functions as follows: In the position of the on-off valve 5 shown in FIG. 3, the fuel volume contained in the high-pressure reservoir flows through the high-pressure connection 3 to the first housing part 8. The highly pressurized fuel flows via the inlet 13 branching off from the high-pressure line 3 and into the working chamber 12 of the pressure booster. By means of the inlet 6 to the on-off valve 5, the fuel flows via the overflow line 43 to the piston part 60 incorporated into the pressure booster piston 14 and passes through this piston part via the conduit 40 that constitutes a section of the central control line 31. Then the fuel flows into the chamber 63, from which it travels via the lateral opening 41 into the differential pressure chamber 17 of the pressure booster 11. Consequently, in the position of the on-off valve 5 shown in FIG. 3, this differential pressure chamber 17 remains at the pressure level prevailing in the high-pressure reservoir 2. By means of the differential pressure chamber 17 of the pressure booster 11, fuel flows through the discharge line 29 into the control chamber 20. Via the control chamber 20, the high-pressure chamber 19 of the pressure booster above the control chamber 20 is likewise acted on by fuel, which is conveyed into the nozzle chamber 23 via the nozzle chamber inlet 22. In this switched position of the pressure booster 11, i.e. its active state, the injection valve element 24 remains closed and no fuel is injected through the injection openings 25 into the combustion chamber 26 of the autoignition internal combustion engine.

A relief of the pressure in the differential pressure chamber 17 of the pressure booster 11 is produced through actuation of the on-off valve 5. When the on-off valve 5 is actuated, the overflow line 43 is brought into connection with the low-pressure side return 7 as a result of which the pressure in the differential pressure chamber 17 is relieved into the low-pressure side return via the lateral opening 41, the chamber 63, and the central control line 31 (conduit 40) contained in the piston part 60. The fuel in the working chamber 12 acts on the first end 15 of the pressure booster piston 14, causing the end of the pressure booster piston 14 oriented toward the high-pressure chamber 19 to travel into this high-pressure chamber.

When the on-off valve 5 is actuated, low pressure prevails in the overflow line 43 and therefore against the upper piston surface of the piston part 60. The area of the piston part 60 in the working chamber 12 generates a hydraulic sealing force. This presses the piston part 60 against the housing part 8. In addition, it is also possible for the piston part to be prestressed by means of a spring in order to press it against the lower end surface of the housing part 8 delimiting the working chamber 12.

When the lower end of the pressure booster piston 14 travels into the high-pressure chamber 19, this increases the pressure of the fuel contained therein in accordance with the pressure boosting ratio of the pressure booster 11. The fuel flows from the high-pressure chamber 19 to the nozzle chamber 23 via the nozzle chamber inlet 22. In the region of the nozzle chamber 23, the injection valve element 24, which can be embodied for example as a nozzle needle, has a pressure shoulder that causes the injection valve element 24 to move vertically in the opening direction, i.e. into the control chamber 20, in response to the highly pressurized fuel flowing into the nozzle chamber 23. The fuel contained in the nozzle chamber 23 flows through the annular gap encompassing the injection valve element 24, to injection openings 25 and from there, is injected into the combustion chamber 26 of the autoignition internal combustion engine. The fuel volume displaced when the nozzle of the injection valve element 24 travels upward in the nozzle control chamber 20 flows through the discharge line 29 and the throttle restriction 30 contained therein, and to the pressure-relieved differential pressure chamber 17. From there, the displaced control volume flows through the lateral opening 41, the chamber 63, the central control line 31 inside the piston part 60, and the overflow line 43 to the on-off valve 5 and from there, into the low-pressure side return 7.

Both during filling and during pressure relief of the differential pressure chamber 17 of the pressure booster 11, the working chamber 12, which is continuously acted on by the fuel pressure level contained in the high-pressure reservoir 2, is effectively sealed off from the central control line 31, which extends in the form of a conduit 40 through the piston part 60. Manufacture-related component tolerances between the first housing part 8 and the second housing part 9 can be advantageously compensated for by providing a flat seat 61 in the head region, i.e. at the enlarged end of the piston part 60 oriented toward the first housing part 8.

Figure 4:
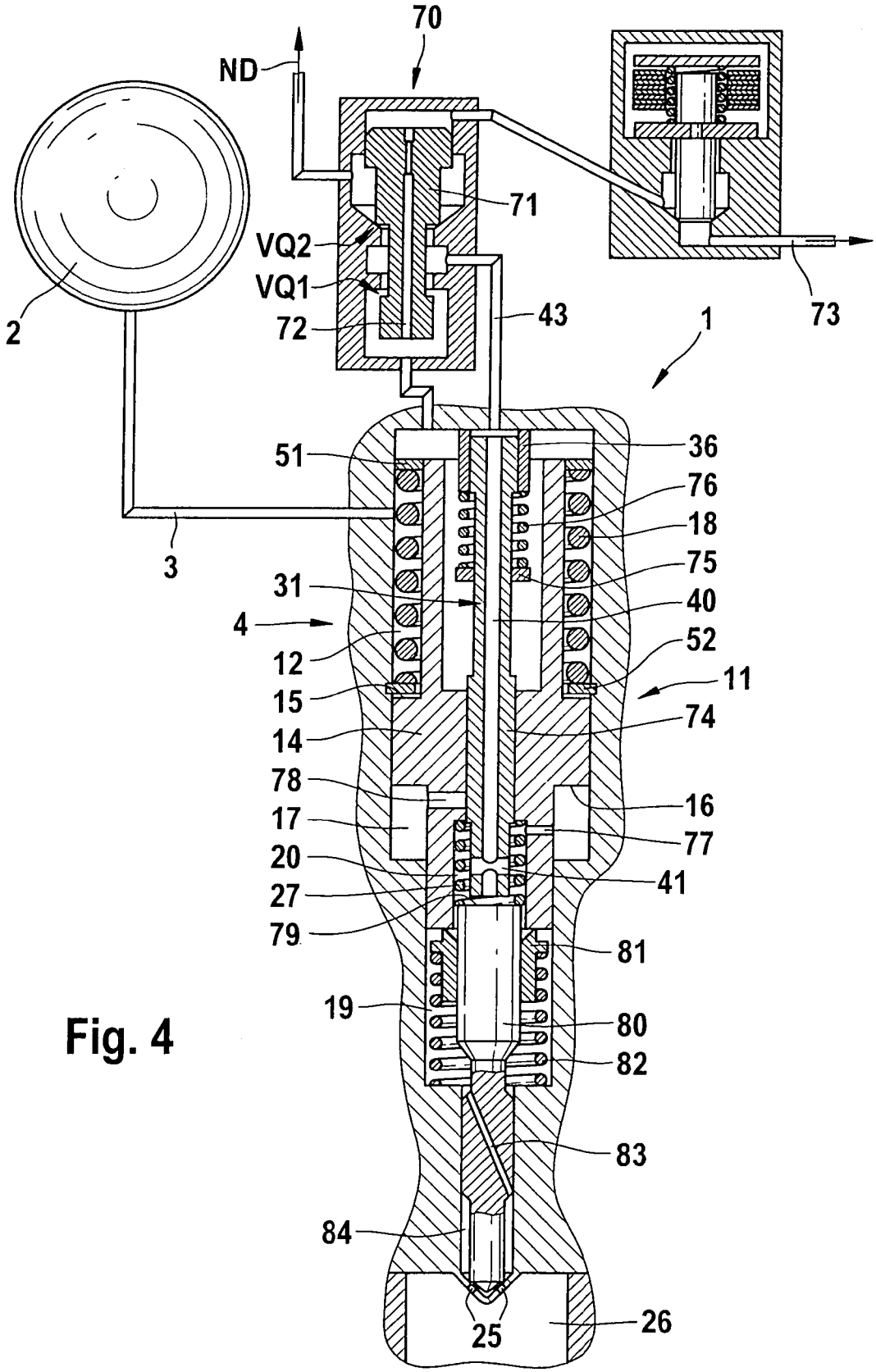
FIG. 4 shows a fuel injector with pressure booster, which is triggered by means of a servo-hydraulically assisted 3/2-way valve.

FIG. 4 shows a fuel injector with pressure booster, which is triggered by a servo-hydraulically designed 3/2-way valve.

In the fuel injection device shown in FIG. 4, the injector, which contains a pressure booster 11, is likewise triggered by means of an on-off valve 70, which is disposed at the upper end of the fuel injection device 1 but which in this case, is embodied in the form of a servo-hydraulic 3/2-way valve.

Highly pressurized fuel flows from the high-pressure reservoir 2 via the high-pressure line 3 into the working chamber 12 of the pressure booster 11. In this exemplary embodiment, the working chamber 12 is disposed in the upper region of the injector body 4 of the fuel injection device 1. The servo-hydraulic on-off valve 70 has a servo piston (valve body 71) and a control valve disposed in the return 73. The on-off valve 70 is connected to the working chamber 12 of the pressure booster via a line. The letters ND indicate a low-pressure side return that likewise branches off from the valve housing of the on-off valve 70. When the on-off valve 70 is in the idle state, a control edge labeled VQ1 is open and a control edge labeled VQ2 is closed. The control line 31 is consequently connected to the working chamber 12 of the pressure booster. When the valve 70 is switched, the control edge VQ1 is closed and the control edge VQ2 is opened so that the central control line 31 is connected to the low-pressure side return ND.

The servo-hydraulic 3/2-way valve has a low-pressure side return 73 leading from it to a fuel reservoir not shown in FIG. 4, for example the tank of a motor vehicle. The servo-hydraulic 3/2-way valve has a valve body 71 with a through bore 72 passing through it, which contains a throttle restriction.

The pressure booster piston 14 seals the working chamber 12 of the pressure booster 11 off from the differential pressure chamber 17 integrated into the injector body 4. The return spring 18 is contained in the working chamber 12 of the pressure booster 11. This return spring 18, encompassing a sleeve-shaped region of the pressure booster piston 14, rests against the first washer 51 and the second washer 52. The first washer 51 is attached to the upper end of the pressure booster piston 14, while the second washer 52 can be inserted into the wall of the injector body 4. The second washer 52 is disposed above the first end 15 of the pressure booster piston while the second end 16 of the pressure booster piston 14 constitutes a delimiting surface of the differential pressure chamber 17 of the pressure booster 11.

In the exemplary embodiment of the fuel injection device 1 shown in FIG. 4, the control chamber 20 of an injection valve element 80 is integrated into the pressure booster piston 14. The nozzle spring 27 that acts on an end 79 of the injection valve element 80 is contained inside the control pressure chamber 20. The injection valve element 80 according to the exemplary embodiment in FIG. 4 is encompassed by the high-pressure chamber 19 of the pressure booster 11, i.e. in this exemplary embodiment, the high-pressure chamber 19 and the nozzle chamber 23 are identical. According to the exemplary embodiment in FIG. 4, the nozzle chamber 23 is constituted by the high-pressure chamber 19 of the pressure booster 11. In the high-pressure chamber 19 of the pressure booster piston 14, the injection valve element 80 is encompassed by a sealing sleeve 81. A spring element 82, which is contained in the high-pressure chamber 19 of the pressure booster 11, acts on the sealing sleeve 81 and presses it tightly against the end of piston 14 oriented toward the high-pressure chamber 19 of the pressure booster 11 so that the control chamber 20 and a coaxial piston 74 that travels into it are sealed off from the high-pressure chamber 19. The injection valve element 80 has a fuel conduit 83 that passes through the injection valve 80 at an inclined angle, which feeds into an annular gap 84 between the injection valve element 80 and the injector body 4 at the end of the fuel injection device 1 oriented toward the combustion chamber. Below the annular chamber 84 in the injector body 4, the seat at the combustion chamber end of the injection valve element 80 is closed.

According to the exemplary embodiment in FIG. 4, the pressure booster piston 14 has a coaxial piston 74 integrated into it, which is disposed symmetrical to the symmetry axis of the injector body 4 of the fuel injection device 1 and is contained in a stationary fashion inside the injector body 4. The pressure booster piston 14 can be moved in relation to this coaxial piston. The conduit 40 that serves as the central control line 31 for exerting pressure on or relieving pressure in the differential pressure chamber 17 passes through the coaxial piston 74. Inside the sleeve-shaped region of the pressure booster piston 14, the coaxial piston 74 has a support surface 75. A prestressed spring 76 rests against the support surface 75 and presses the sealing sleeve 36 tightly against the injector body 4. This makes it possible to compensate for manufacturing tolerances in multi-part injector housings. This makes it possible to compensate for manufacturing tolerances in multi-part injector housings. In this manner, the central control line 31 is sealed off from the high pressure prevailing in the high-pressure reservoir 2 that is also present in the working chamber 12 via the high-pressure line 3. At the end of the coaxial piston 74 oriented away from the sealing sleeve 36, the coaxial piston is encompassed by the nozzle spring 27 contained in the control chamber 20. The lateral opening 41 passes through the coaxial piston 74 in the region of the control chamber 20. Between the differential pressure chamber 17 and the control chamber 20, there is a first connection via a first outlet cross section 77 and a second connection constituted by the second outlet cross section 78. In comparison to the second outlet cross section 78, the first outlet cross section 77 has a smaller flow cross section and is always effective, whereas the second outlet cross section 78 is opened or closed in accordance with the stroke path of the pressure booster piston 14 of the pressure booster 11.

In the switched position of the servo-hydraulic 3/2-way valve 70 shown in FIG. 4, the valve is closed. The pressure level prevailing in the high-pressure chamber 2 prevails in the working chamber 12 of the pressure booster 11 via the high-pressure line 3 extending from the high-pressure reservoir 2 into the working chamber 12. The differential pressure chamber 17 of the pressure booster 11 is acted on with fuel pressure via the open control edge VQ1 (valve cross section) and the central control line 31 in accordance with the pressure level prevailing in the working chamber 12. The control chamber 20 is likewise acted on with the pressure level prevailing in the high-pressure reservoir via the first outlet cross section 77. This pressure level is also present at the servo-hydraulic 3/2-way valve 70 via the lateral opening 41 and the conduit 40 that serves as the central control line 31.

The second sealing sleeve 81 seals the control chamber 20 and therefore the differential pressure chamber 17 of the pressure booster 11 off from the high-pressure chamber 19, which functions as a nozzle chamber in the pressure booster 11. The prestressing spring 82 contained in the high-pressure chamber 19 acts on the second sealing sleeve 81 and assists it in its sealing action.

With the exemplary embodiment shown in FIG. 4, it is possible to shape the pressure buildup and pressure decrease by means of the pressure booster 11 in order to achieve an optimal injection pressure curve for the internal combustion engine. This is achieved by the provision of an outlet cross section from the differential pressure chamber that depends on the stroke of the pressure booster piston 14. When the servo-hydraulically actuated 3/2-way valve 70 used as the on-off valve is switched into its open position, the fuel volume contained in the differential pressure chamber 17 flows into the control chamber 20 via the first outlet cross section 77 and into the central control line 31 embodied in the form of a conduit 40 via the lateral opening 41. The fuel flows into the servo-hydraulic on-off valve 70 via the overflow line 43 connected to the injector body 4 and flows into the low-pressure side return ND via the control edge VQ2 (valve cross section). Because the decrease of pressure in the differential pressure chamber 17 of the pressure booster 11 via the first outlet cross section 77 only occurs slowly, the pressure increases in the high-pressure chamber 19 of the pressure booster 11 in a gradual, damped fashion. With increasing stroke of the pressure booster piston 14, i.e. as it travels further into the differential pressure chamber 17, this opens the second, larger-dimensioned outlet cross section 78 in a stroke-dependent fashion. If it is completely opened because there is no overlap with the coaxial piston 74, then a complete pressure decrease in the differential pressure chamber 17 occurs; the diverted fuel volume flows via the central control line 31 into the overflow line 43 and from there, via the servo-hydraulic valve 70 that has moved away from its open position, into the low-pressure side return to a fuel tank that is not shown in FIG. 4.

The pressure relief of the differential pressure chamber 17 occurring via the outlet cross sections 77 and 78 causes a pressure increase to occur in the high-pressure chamber 19 in accordance with the boosting ratio of the pressure booster 11, which high-pressure chamber 19 functions as a nozzle chamber in the exemplary embodiment according to FIG. 4. The second sealing sleeve 81 that is acted on by the spring 82 seals the high-pressure chamber 19 off from the control chamber 20 so that no overflow of fuel occurs. The pressure increase that occurs in the high-pressure chamber 19 when the pressure booster piston 17 is traveling into it causes the pressure to increase significantly. The increasing fuel pressure acts on a pressure shoulder embodied on the injection valve element 80, which travels upward into the control chamber 20, i.e. opens, counter to the force of the nozzle spring 27. Fuel, which is acted on with an increased booster pressure, flows out of the high-pressure chamber 19 of the pressure booster 11, via the fuel conduit 83, and into the annular gap 84. The injection openings that are unblocked by the movement of the injection valve element 80 away from its seat are opened so that fuel can flow from the high-pressure chamber 19, through the fuel conduit 83 and the annular gap 84, and can be injected into the combustion chamber 26 of the autoignition internal combustion engine.

The foregoing relates to preferred exemplary embodiments of the invention, it being understood that other variants and embodiments thereof are possible within the spirit and scope of the invention, the latter being defined by the appended claims.

The invention claimed is:

1. A fuel injection device (1) adapted to be connected to a high-pressure source (2), said fuel injection device (1) comprising:

a multi-part injector body (4; 8, 9, 10);

an injection valve clement (24) in said multi-part injector body for blocking or unblocking at least one injection opening (25);

a nozzle chamber (23) enclosing the injection valve element in the region of a pressure shoulder provided on the injection valve element (24);

a pressure booster (11) provided in said multi-part injector body, said pressure booster (11) comprising a pressure booster piston (14), a working chamber (12) on one side of said piston and a differential pressure chamber (17) on an opposite side of said pressure booster piston, said pressure booster piston (14) sealing the working chamber (12) off from the differential pressure chamber (17), said pressure booster piston (14) being actuated by means of a pressure change in said differential pressure chamber (17), a high-pressure chamber (19) defined, at least in part, by an end face (14*a*) of the pressure boosting a piston (14);

a nozzle chamber inlet (22) hydraulically connecting the nozzle chamber (23) with the high-pressure chamber (19);

a control chamber (20) hydraulically connected to the high-pressure chamber (19);

an on-off valve (5, 70) for actuating said fuel injection device (1);

a central control line (31) extending through said pressure booster piston (14), said pressure change in the differential pressure chamber (17) of the pressure booster (11) occurring via the central control line (31); and wherein the central control line (31) extends essentially coaxially to an axis of symmetry of the pressure booster piston (14), wherein the central control line (31) extends through the working chamber (12) of the pressure booster (11) and further comprising a high-pressure-tight connection (33, 50, 61) for sealing off said central control line (31) from said working chamber (12).

2. The fuel injection device according to claim 1, wherein the central control line (31) extends essentially coaxial to the symmetry axis of the injector body (4; 8, 9, 10).

3. The fuel injection device according to claim 1, wherein the pressure booster piston (14) contains a line section (34, 60, 74) of the central control line (31) through which a conduit (40) constituting the central control line (31) extends in the working chamber (12) of the pressure booster (11), and wherein the line section (34) of the central control line (31) supports a sealing sleeve (36) that can move in relation to said line section (34) and that produces a high-pressure seal (33) for the working chamber (12) and a spring (38, 76) for biasing said sealing sleeve.

4. The fuel injection device according to claim 1, wherein the pressure booster piston (14) contains a line section (34, 60, 74) of the central control line (31) through which a conduit (40) constituting the central control line (31) extends in the working chamber (12) of the pressure booster (11) and wherein the line section (34) has a high-pressure-tight guide section (50) that is guided in a first housing part (8) of the injector body (4; 8, 9, 10).

5. The fuel injection device according to claim 1, wherein the pressure booster piston (14) contains a line section (34, 60, 74) of the central control line (31) through which a conduit (40) constituting the central control line (31) extends in the working chamber (12) of the pressure booster (11) and wherein a piston part (60) that constitutes a line section of the central control line (31) and is encompassed by the pressure booster piston (14) is contained in the pressure booster piston in a sliding fashion and in its head region, is provided with a sealing surface (61) that represents a high-pressure-tight connection.

6. The fuel injection device according to claim 3, wherein said spring (38, 76) rests against either the line section (74) or against an end (15) of the pressure booster piston (14) and presses the sealing sleeve (36) against t e injector body (4; 8, 9, 10).

7. A fuel injection device (1) adapted to be connected to a high-pressure source (2), said fuel injection device (1) comprising:

a multi-part injector body (4; 8, 9, 10);

an injection valve element (24) in said multi-part injector body for blocking or unblocking at least one injection opening (25);

a nozzle chamber (23) enclosing the injection valve element in the region of a pressure shoulder provided on the injection valve element (24);

a pressure booster (11) provided in said multi-part injector body, said pressure booster (11) comprising a pressure booster piston (14), a working chamber (12) on one side of said piston and a differential pressure chamber (17) on an opposite side of said pressure booster piston, said pressure booster piston (14) sealing the working chamber (12) off from the differential pressure chamber (17), said pressure booster piston (14) being actuated by means of a pressure change in said differential pressure chamber (17), a high-pressure chamber (19) defined, at least in part, by an end face (14*a*) of the pressure boosting piston (14);

a nozzle chamber inlet (22) hydraulically connecting the nozzle chamber (23) with the high-pressure chamber (19);

a control chamber (20) hydraulically connected to the high-pressure chamber (19);

an on-off valve (5, 70) for actuating said fuel injection device (1);

a central control line (31) extending through said pressure booster piston (14), said pressure change in the differential pressure chamber (17) of the pressure booster (11) occurring via the central control line (31); and wherein the central control line (31) extends essentially coaxially to an axis of symmetry of the pressure booster piston (14), wherein the pressure booster piston (14) contains a line section (34, 60, 74) of the central control line (31) through which a conduit (40) constituting the central control line (31) extends in the working chamber (12) of the pressure booster (11).

8. The fuel injection device according to claim 7, wherein the conduit (40) feeds into a recess (35) inside a first housing part (8) of the injector body (4; 8, 9, 10), which recess is connected to the on-off valve (5, 70) via an overflow line (43).

9. The fuel injection device according to claim 7, wherein the line section of the central control line (31) is embodied as a tubular piston extension (34).

10. The fuel injection device according to claim 7, wherein the line section of the central control line (31) is embodied as a coaxial piston (74) that the pressure booster piston (14) can move in relation to.

11. The fuel injection device according to claim 7, wherein a piston part (60) that constitutes said line section of the central control line (31)as a hydraulically effective surface and is pressed against a boundary surface of the working chamber (12) of the pressure booster (11) by fluid contained in the working chamber (12), thus producing a high-pressure-tight connection (61).

* * * * *